US006854307B2

(12) United States Patent
Mazzarello

(10) Patent No.: US 6,854,307 B2
(45) Date of Patent: Feb. 15, 2005

(54) LOCK-PICKING PREVENTION APPARATUS

(75) Inventor: Gianpiero Toni Mazzarello, 1-11-8 Kitami, Setagaya-ku, Tokyo 157-0067 (JP)

(73) Assignees: Newing Corporation (JP); Advance & Technology Corporation (JP); Gianpiero Toni Mazzarello (JP)

( * ) Notice: Subject to any disclaimer, the term of this patent is extended or adjusted under 35 U.S.C. 154(b) by 0 days.

(21) Appl. No.: 10/437,598

(22) Filed: May 14, 2003

(65) Prior Publication Data

US 2003/0213274 A1 Nov. 20, 2003

(30) Foreign Application Priority Data

May 19, 2002 (JP) ..... 2002-003845
Oct. 9, 2002 (JP) ..... 2002-007287

(51) Int. Cl.[7] ..... E05B 17/14
(52) U.S. Cl. ..... 70/428; 70/455; 70/DIG. 63
(58) Field of Search ..... 70/58, 394, 419, 70/424, 427, 428, 423, 455, 430, DIG. 63

(56) References Cited

U.S. PATENT DOCUMENTS 925,302 A * 6/1909 Cropp ..... 70/428
934,928 A * 9/1909 Michel ..... 70/423
965,316 A * 7/1910 Muller ..... 70/428
1,705,072 A * 3/1929 Hiram ..... 70/428
1,713,602 A * 5/1929 Heiden ..... 70/428
1,728,310 A * 9/1929 Sundel ..... 70/428
2,087,423 A * 7/1937 Abrams ..... 33/540
2,662,390 A * 12/1953 Michnoff et al. ..... 70/428
3,475,934 A * 11/1969 Reisner ..... 70/428
4,073,165 A * 2/1978 Grundstrom et al. ..... 70/37
5,355,702 A * 10/1994 Escribens ..... 70/395
6,173,595 B1 * 1/2001 Hughes ..... 70/394
6,397,649 B1 * 6/2002 Naber ..... 70/428

FOREIGN PATENT DOCUMENTS

JP 3008407 Y 3/1995
JP 3022498 Y 3/1996
JP P2002-201831 A 7/2002

OTHER PUBLICATIONS

IDS Information Note explaining relevance of the foreign patent documents, 1 pg.

* cited by examiner

*Primary Examiner*—Lloyd A. Gall
(74) *Attorney, Agent, or Firm*—Osha & May, L.L.P.

(57) ABSTRACT

A lock-picking prevention apparatus is adaptable to a lock (120) having a lock hole (121) and an abutment driver pin (122) for restricting and releasing a key. The apparatus includes a locking body (102) having a front end abutment hook (102*d*) abutted by the abutment driver pin (122) when the lock-picking prevention apparatus is inserted into the lock hole (121) so as to bury its internal space, an operating bar (102) provided so as to slide over the abutment driver pin (122) to provide guidance, and a new key (110). At the time of unlocking using the new key (110), the operating bar (103) pushes in the abutment driver pin (122) to release the abutment of the front end abutment hook (102*d*) so as to enable the locking body (102) to be pulled out. The lock-picking prevention apparatus brings about a situation which is equivalent to a plurality of locks being provided.

4 Claims, 10 Drawing Sheets

LOCK-PICKING PREVENTION APPARATUS

CROSS-REFERENCE TO RELATED APPLICATIONS

This patent application claims priority from Japanese Patent Application No. JP-2002-3845 U, filed on May 19, 2002, and Japanese Patent Application No. JP-2002-7287, U filed on Oct. 9, 2002.

BACKGROUND OF INVENTION

1. Field of the Invention

The present invention relates to a lock-picking prevention apparatus capable of being fitted simply by being inserted into an existing lock hole and providing a situation equivalent to providing a plurality of locks without actually providing a plurality of locks.

The present invention relates to a lock-picking prevention apparatus preventing picking where locks are unlocked by inserting tools between a gap existing due to looseness of a cylinder bezel.

2. Background Art

Typical lock apparatus are easily unlocked using a simple picking tool, etc. There are therefore many crimes that occur relating to illegal unlocking of lock apparatus. In order to prevent illegal unlocking, it is effective to change the current lock apparatus or to have a plurality of locks by adding a new lock to the lock currently in use.

With one type of lock, a cylinder bezel projects on the front side of a door. A cylinder bezel type of lock can be unlocked by inserting a tool into a gap between a cylinder bezel and a door. It is therefore necessary to remove this play from the cylinder bezel in order to prevent illegal unlocking.

In these days where there are many crimes of illegal unlocking of lock apparatus, the object of the present invention is to provide a lock-picking prevention apparatus giving the same effect as providing a plurality of locks but which is merely inserted without replacing the current lock apparatus with a new one and without actually constructing a plurality of locks.

A further object of the present invention is also to provide a lock-picking prevention apparatus capable of eliminating play of a lock provided with a cylinder bezel.

SUMMARY OF INVENTION

A lock-picking apparatus of the present invention, which is adaptable to a lock having a lock hole and an abutment driver pin for restricting and releasing a key, comprising: a locking body having a front end abutment hook restricted by the abutment driver pin when being inserted so that the inner space of the lock hole is buried; and an operating bar provided so as to guide by sliding with respect to the abutment driver pin, wherein at the time of unlocking, the operating bar pushes the abutment driver pin in and releases the restriction of the front end abutment hook to enable the locking body to be withdrawn.

In one or more embodiments, a lock-picking prevention apparatus further comprises: a cam plate having holding holes engaging with a rear end projection of the operating bar and being supported in a freely rotatable manner; and a new key, wherein the new key is capable of rotating around the cam plate, and at the time of unlocking, when the new key engaged with the cam plate is rotated, the operating bar pushes the abutment driver pin in.

In one or more embodiments, the locking body has a rotating hole provided at the rear part of the locking body, and a slit made in a direction from the rotating hole to the rear end of the locking body; the operating bar has an operating pin connected to the rear end portion of the operating bar at a right angle engaging with the rotating hole; wherein, when a force for rotating the operating pin exceeds a prescribed restricting strength, the operating pin comes out of the slit.

In one or more embodiments, the locking body has a notch having an angle provided in the lengthwise direction of the rear portion; and when the force acting on the locking body exceeds a prescribed restricting load, the locking body is crushed by the notch.

In one or more embodiments of the present invention, the lock-picking prevention apparatus adaptable to a lock having a key hole and an abutment driver pin also comprises: a first locking body provided with a first insertion head, inserted in the key hole and having a unlocking sliding surface contacting with the abutment driver pin so as to be capable of sliding with respect to the abutment driver pin, and a second locking body provided with a second insert head inserted in the key hole and having a locking hook surface engaging with the abutment driver pin, wherein the first insertion head and the second insertion head are capable of being integrally inserted in the key hole, at the time of unlocking, the first locking body and the second locking body slide over each other, the unlocking sliding surface comes into contact with and slides over the abutment driver pin engaging with the locking hook surface, thus enabling the first locking body and the second locking body to be pulled out from the key hole.

In one or more embodiments, a lock-picking prevention apparatus further comprises: an eccentric cam disk provided in a rotating manner and having a cam eccentric oval projection outer edge fitted in a freely rotating manner to an oval rotating hole provided on the first locking body and a cam circular projection outer edge fitted in a freely rotating manner to a circular rotating hole provided on the second locking body, wherein at the time of unlocking, the first locking body and the second locking body slide over each other as a result of rotation of the eccentric cam disk.

In one or more embodiments, a lock-picking prevention apparatus further comprises: a lock cylinder having a convex cylinder part engaged with an engaging hole provided on the eccentric cam disk; and a new key, wherein the new key is capable of rotating around the lock cylinder. At the time of unlocking, the eccentric cam disk is made to rotate by rotating the lock cylinder using the new key adaptable to the lock cylinder.

In one or more embodiments, a lock-picking prevention apparatus further comprises: a cylinder cap for fixing the cylinder bezel of the lock to the key hole side.

In one or more embodiments, a lock-picking prevention apparatus further comprises: an outer case for the lock cylinder for blocking the key hole.

DETAILED DESCRIPTION

A description will now be given, with reference to the drawings, of a first embodiment of a lock-picking prevention apparatus of the present invention.

A "door" as referred to in this specification means a door for a house, or cover, etc., and may include a lock of a motorcycle petrol tank, etc.

Figure 1:
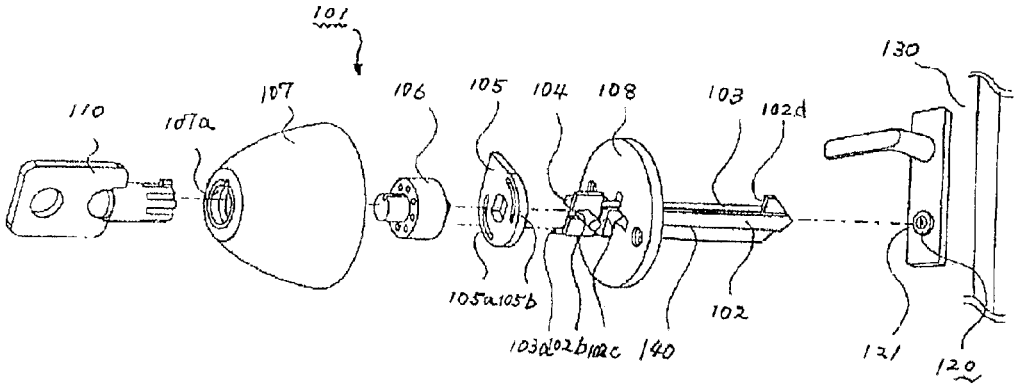
FIG. 1 is an exploded perspective view of a first embodiment of a lock-picking prevention apparatus.
Figure 2:
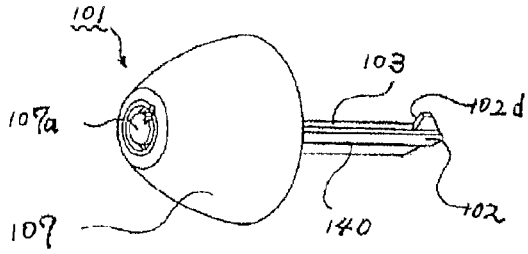
FIG. 2 is a perspective view of the first embodiment of the lock-picking prevention apparatus.
Figure 3:
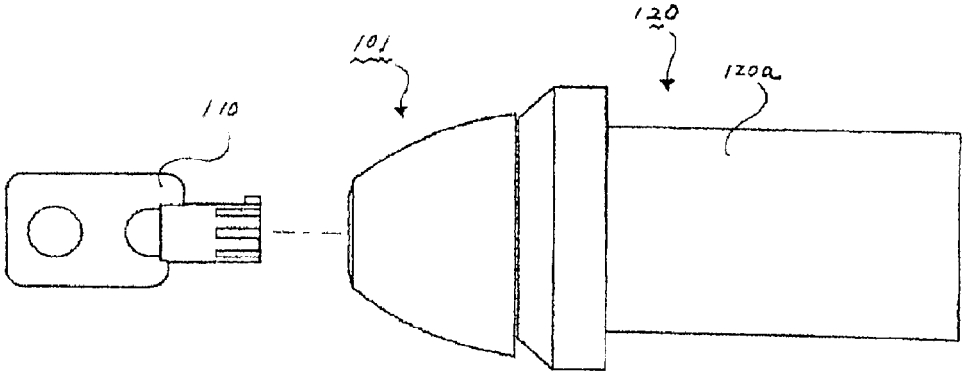
FIG. 3 is a view illustrating a state where the lock-picking prevention apparatus of the first embodiment is inserted into a lock hole of an existing lock.

FIG. 1 is an exploded perspective view of a first embodiment of a lock-picking prevention apparatus 100. In the lock-picking prevention apparatus 101, a locking body 102 and an operating bar 103 are both arranged in the same lengthwise direction. The combination of the locking body 102 and the operating bar 103 is to be inserted into a lock hole 121 of a lock 120 mounted on a door 130.

Figure 6:
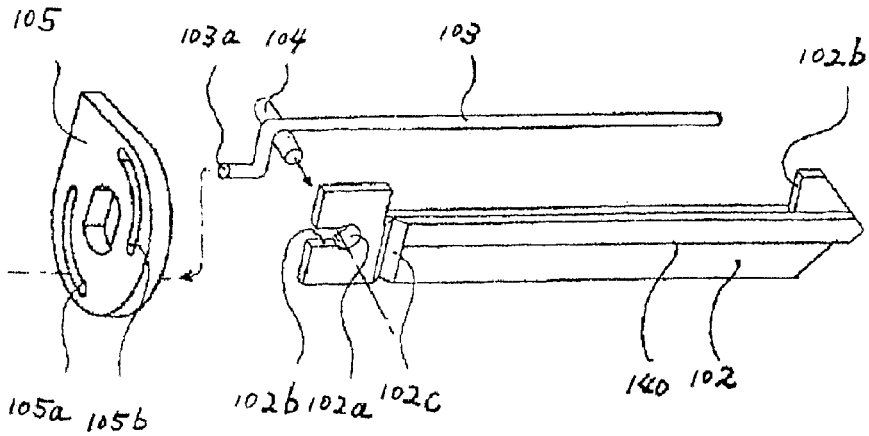
FIG. 6 is an enlarged view of the first embodiment where a locking body, an operating bar and a cam plate are disassembled.

A rotating hole 102*a* and a slit 102*b* are provided on the rear end part of the locking body 102. An operating pin 104 is connected with the curved rear end part of the operating bar 103. The operating pin 104 inserts into the rotating hole 102*a*. FIG. 6 is a partially exploded enlarged view of FIG. 1 showing the state where a notch 102*c* is made on the rear end part of the locking body 102 at a right angle with respect to the lengthwise direction.

FIG. 1 and FIG. 6 show the state where a projection 103*a* is inserted into a holding hole 105*a* provided on a cam plate 105. FIG. 4A, FIG. 4B and FIG. 5A, FIG. 5B show the state where a convex part at the front end of a cylinder 106 engages with a central hole of the cam plate 105. A rear cover 108 and an outer case 107 are integrally fitted together. A cross groove is notched in the center of the rear cover 108. The rear end parts of the locking body 102 and the operating bar 103 are held as a result of insertion into the cross groove.

Figure 4A:
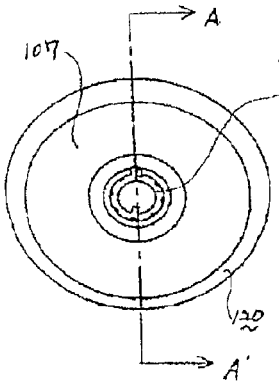
FIGS. 4A and 4B are a front view and a cross-sectional view taken along line A—A of the first embodiment of the lock-picking prevention apparatus.
Figure 4B:
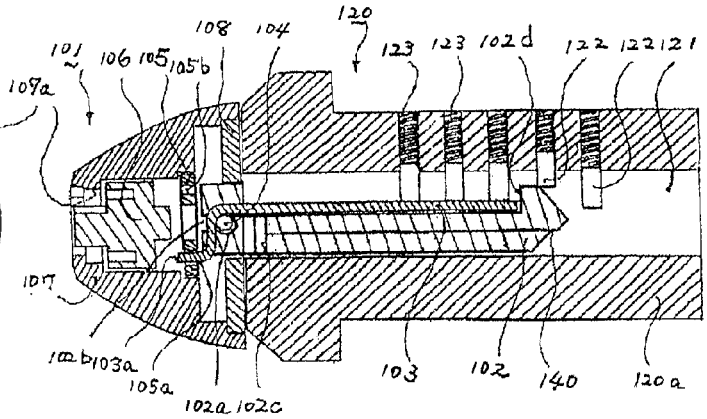

In FIGS. 4A and 4B, the locking body 102 has the front end abutment hook 102*d*, and the locking body 102 is inserted into the lock hole 121 together with the operating bar 103 in parallel. The locking body 102 accompanied by the operating bar 103 pushes up the abutment driver pin 122 and a spring 123 provided in a plug 120*a*. The locking body 102 is inserted and abutted by the abutment driver pin 122 at an arbitrary position.

Figure 5A:
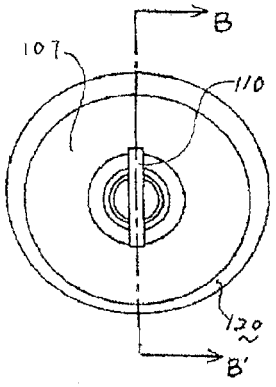
FIG. 5A and 5B are a front view and a cross-sectional view taken along line B—B of the state where the lock-picking prevention apparatus of the first embodiment is inserted and rotated in the existing lock and an operating bar 103 is operated.
Figure 5B:
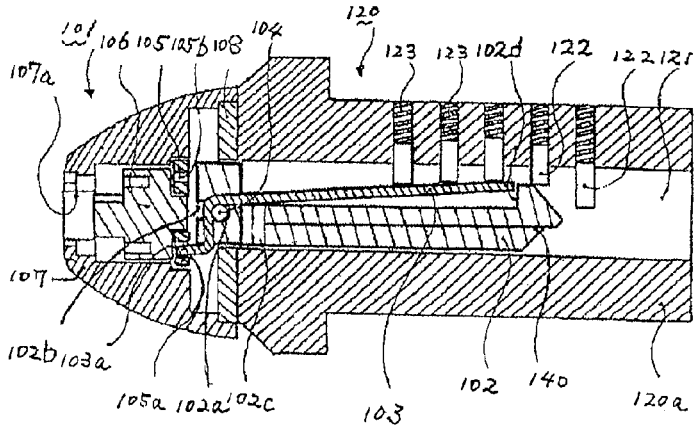

In FIG. 1, when the new key 110 is inserted into the new key hole 107*a* and rotated, the rotation is transmitted from the cylinder 106 to the cam plate 105 to cause a holding hole 105*a* to rotate. The rotation is further transmitted from a projection 103*a* to the operating pin 104 and then transmitted at a right angle with respect to the lengthwise direction of the operating bar 103 via the operating pin 104. In FIGS. 5A and 5B, the operating bar 103 pushes up the abutment driver pin 122 to enable the lock-picking prevention apparatus 101 to be pulled out from the lock hole 121.

There are a number of types of shapes for the lock hole 121. A guide groove is formed at a key-inserting portion in a lengthwise direction so as to correspond to the shape of the lock hole 121. FIG. 6 therefore shows that it is necessary to provide a guide groove 140 of the same shape as the shape of the locking body 102 in order to broaden the usage range of the lock-picking prevention apparatus 101 of the present invention.

Figure 7:
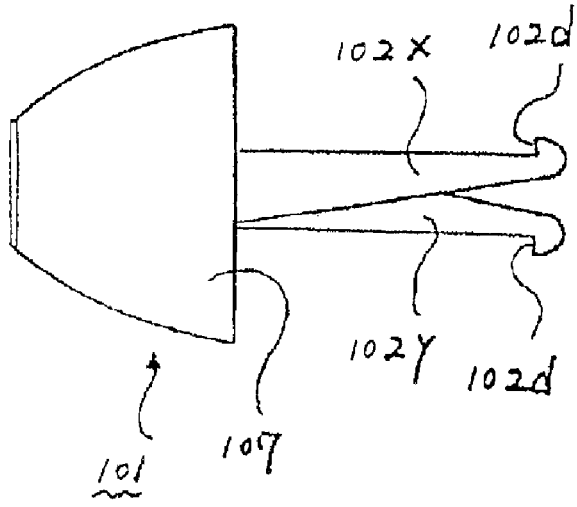
FIG. 7 is a perspective view of a second embodiment of the lock-picking prevention apparatus.
Figure 8:
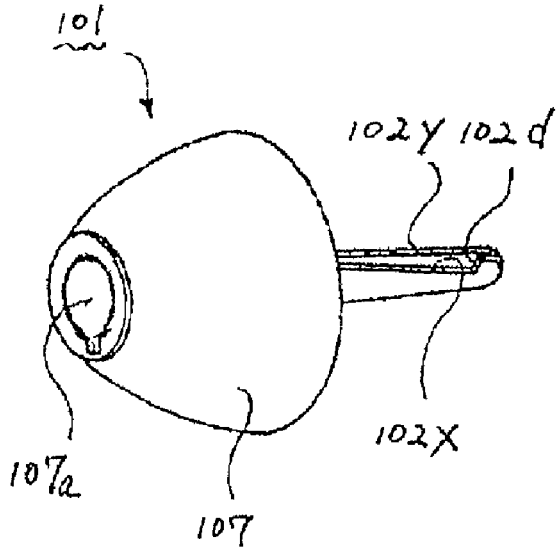
FIG. 8 is a schematic block diagram of the second embodiment of the lock-picking prevention apparatus.

A description will be given of a second embodiment of a lock-picking prevention apparatus of the present invention based on FIG. 7 and FIG. 8.

A difference from the first embodiment is that the second embodiment is provided with two locking bodies 102, but not an operating bar 103. These two locking bodies are respectively called A locking body 102*x* and B locking body 102*y*. The A locking body 102*x* and the B locking body 102*y* are arranged in the lengthwise direction in parallel so as to make contact with and slide over each other. The rear end of the A locking body 102*x* and the rear end of the B locking body 102*y* cross each other and are joined in a freely rotating manner by a operating pin (not shown). These two locking bodies 102 respectively have an A projection (not shown) and a B projection (not shown) similarly to the projection 103*a* of the operating bar 103 of the first embodiment. The A projection is engaged and inserted into a holding hole 5*a* of a cam plate 5. The B projection is engaged and inserted into a holding hole 5*b* of the cam plate 5.

There are a number of types of shape for a lock hole. A guide groove has been formed at the key insertion portion in the lengthwise direction so as to correspond to this shape. In FIG. 7, the A locking body 102*x* and the B locking body 102*y* are respectively made from a thin plate and are not provided with a guide groove. In the second embodiment, the lock-picking prevention apparatus can be inserted into the lock hole without having a guide groove.

A description will now be given of a usage method and effect of the first and the second embodiments of the lock-picking prevention apparatus.

An existing lock 120 is fitted on a door 130. The lock 120 is locked using the existing lock. After that, the lock-picking prevention apparatus 101 is inserted into a lock hole 121. Inside of the lock hole 121 of the lock 120, the front end part of the locking body accompanied by the operating bar 103 pushes the abutment driver pin 122 and the spring 123, so that the lock-picking prevention apparatus 101 is inserted into the lock hole 121. The locking body 102 completely blocks the lock hole 121 of the existing lock 120 fitted on the door 130 etc.

The front end abutment hook 102*d* is abutted by the abutment driver pin 122 located at the deepest part of a plug 120*a*, so that the lock-picking prevention apparatus 101 can not be pulled out from the lock hole 121 without the new key 110.

It is therefore necessary to unlock two locks in order to open the door 130. In one or more embodiments, the lock-picking prevention apparatus easily brings about an effect equivalent to providing a plurality of locks without actually having to construct a plurality of locks on the door. Further, picking the lock is extremely difficult.

In order to unlock the lock, as shown in FIG. 5A and FIG. 5B, the new key 110 is inserted into the new key hole 107*a* to cause the cylinder 106 and the cam plate 105 to rotate, the front end part of the operating bar 103 is moved up by rotating the bar taking the operating pin 104 as a center, and the operating bar 103 pushes up the abutment driver pin 122 to release the abutment of the front end abutment hook 102*d*. The lock-picking prevention apparatus 101 can therefore be pulled out using this operation. After the lock-picking prevention apparatus 101 is pulled out, the existing lock 120 is unlocked using the existing key.

If illegal unlocking is performed by lock picking, etc., and an inappropriate force exceeding the strength limit is applied to the operating pin 104 while the lock-picking prevention apparatus 101 has been mounted on the lock 120 of the door 130, the operating pin 104 may come off together with the operating bar 3 in the direction from the slit 102*b* at the rear end part of the locking body 102 to the rear end.

Also, when an incorrect force exceeding the strength limit is applied to the notch 102*c* of the rear end part of the locking body 102, the locking body 102 collapses at the rear end part.

When the lock-picking prevention apparatus 101 is damaged as described above by being subjected to an inappropriate force as a result of a lock-picking operation, etc., the locking body 102 is no longer able to be pulled out unless the door lock is taken apart, so that a lock-picking operation can no longer be carried out easily. The level of security is therefore vastly improved.

The usage method of the second embodiment of the lock-picking prevention apparatus of the present invention is similar to the usage method described above. However, the A locking body 102*x* and the B locking body 102*y* are a pair of bodies lined up next to each other, so that the front end abutment hooks 102*d* at the each front end are respectively abutted upwards and downwards. The lock-picking prevention apparatus can be mounted on the lock 120 in a structure where the abutment driver pin 122 and the spring 123 are provided at upper and lower parts of the plug 120*a*, so that a number of locks for which the lock-picking prevention apparatus may be adapted is increased.

As described above, the lock-picking prevention apparatus of the present invention in the first and second embodiments has the following effects due to its structure.

After inserting the lock-picking prevention apparatus 101 into the lock hole 121 after locking the lock 120 mounted on the door 130 using the existing key in the lock hole 121 of the lock 120, the front end part of the locking body 102 accompanied by the operating bar 103 pushes up the abutment driver pin 122 and the spring 123 to completely block the lock hole 121 of the lock 120 mounted on the existing door 130, etc. Further, the front end abutment hook 102*d* is abutted by the abutment driver pin 122 located deep in the plug 120*a*, so that it is impossible to pull out the lock-picking prevention apparatus 101 without the new key 110. In one or more embodiments, when another lock is mounted on the existing lock, it brings about a situation equivalent to having a plurality of locks on a door without actually providing a plurality of locks on the door, so as to make picking the lock extremely difficult. This is by no means limited to a door, and may be any item having a lock such as an oil tank of a motorcycle, etc.

In one or more embodiments, illegal unlocking is performed by lock picking, etc., and an inappropriate force exceeding the strength limit is applied to the operating pin 104 while the lock-picking prevention apparatus 101 is mounted on the lock 120 of the door 130, the operating pin 104 comes off together with the operating bar 103 in the direction from the slit 102*b* at the rear end part of the locking body 102 to the rear end. It is therefore impossible to open the door unless the lock 120 at the door side is taken apart, so that a picking operation can not be easily pursued. The level of security is therefore vastly improved.

Also, in one or more embodiments, when the notch 102*c* at the rear end part of the locking body 102 of the lock-picking prevention apparatus 101 is subjected to an inappropriate force exceeding the strength limit, the locking body 102 collapses at the rear end part. When the lock-picking prevention apparatus 101 is damaged as a result of being subjected to an inappropriate force resulting from a lock-picking operation, etc., the locking body 102 is no longer capable of being pulled out unless the lock at the door side is taken apart, so that picking operation can not be easily pursued. The level of security is therefore vastly improved.

A description will now be given, with reference to the drawings, of a third embodiment of a lock-picking prevention apparatus of the present invention.

Figures 9A, 9B:
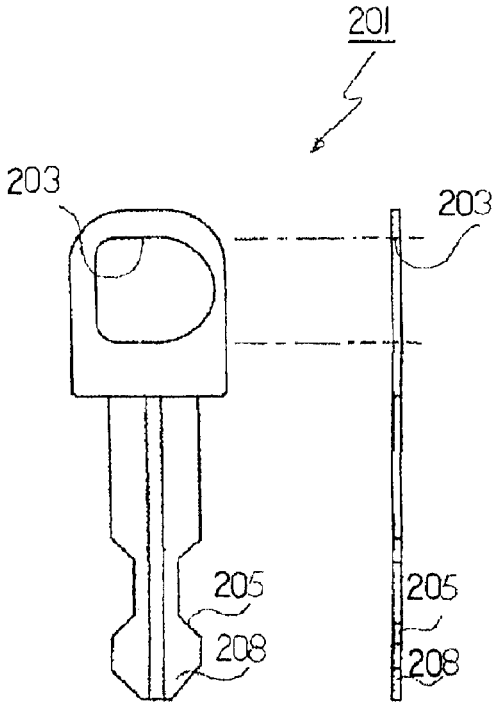
FIGS. 9A and 9B are a front view and a side view of a first locking body of a third embodiment of the lock-picking prevention apparatus.
Figures 10A, 10B:
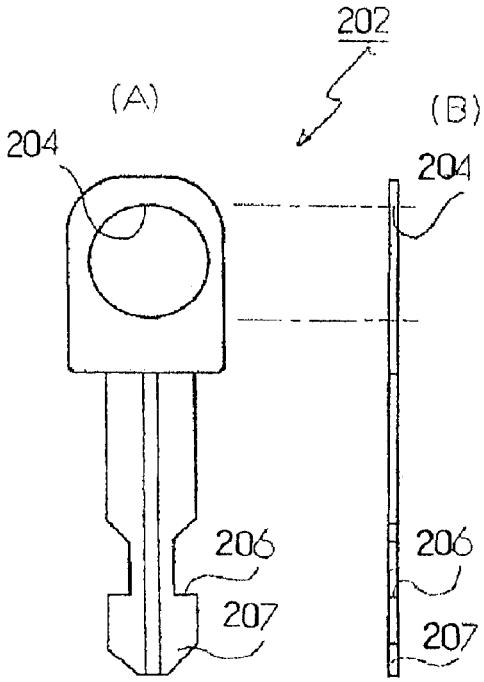
FIGS. 10A and 10B are a front view and a side view of a second locking body of the third embodiment of the lock-picking prevention apparatus.
Figures 11A, 11B, 11C:
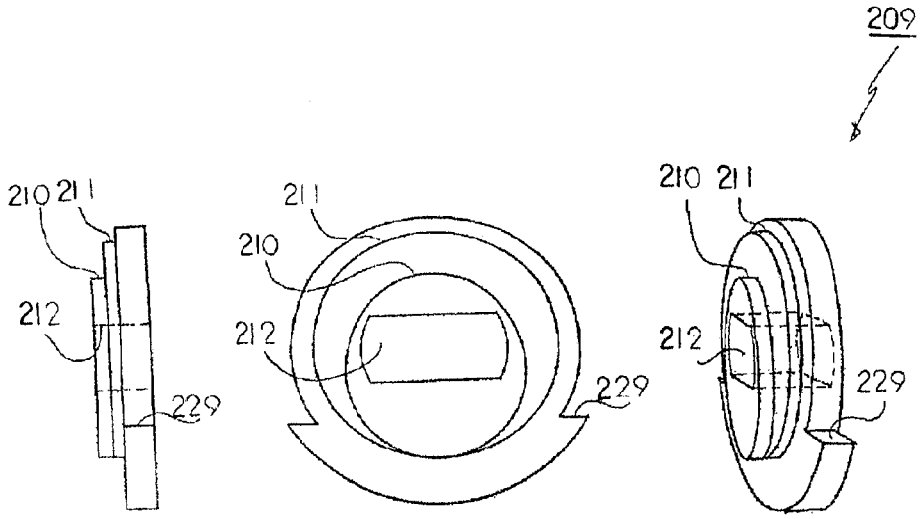
FIGS. 11A to 11C are a side view, a front view, and a perspective view of an eccentric cam disk of the third embodiment of the lock-picking prevention apparatus.
Figure 12:
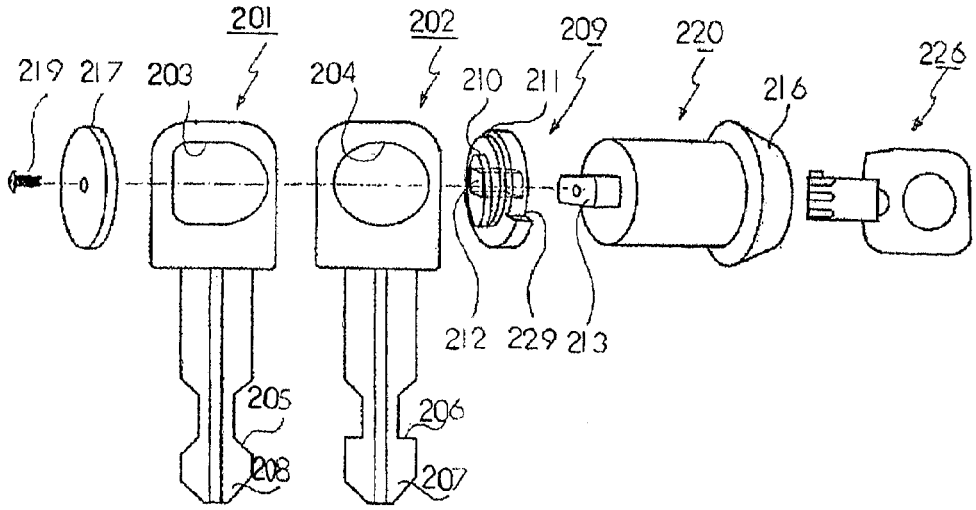
FIG. 12 is an exploded view of a rotating part of the third embodiment of the lock-picking prevention apparatus.
Figure 13:
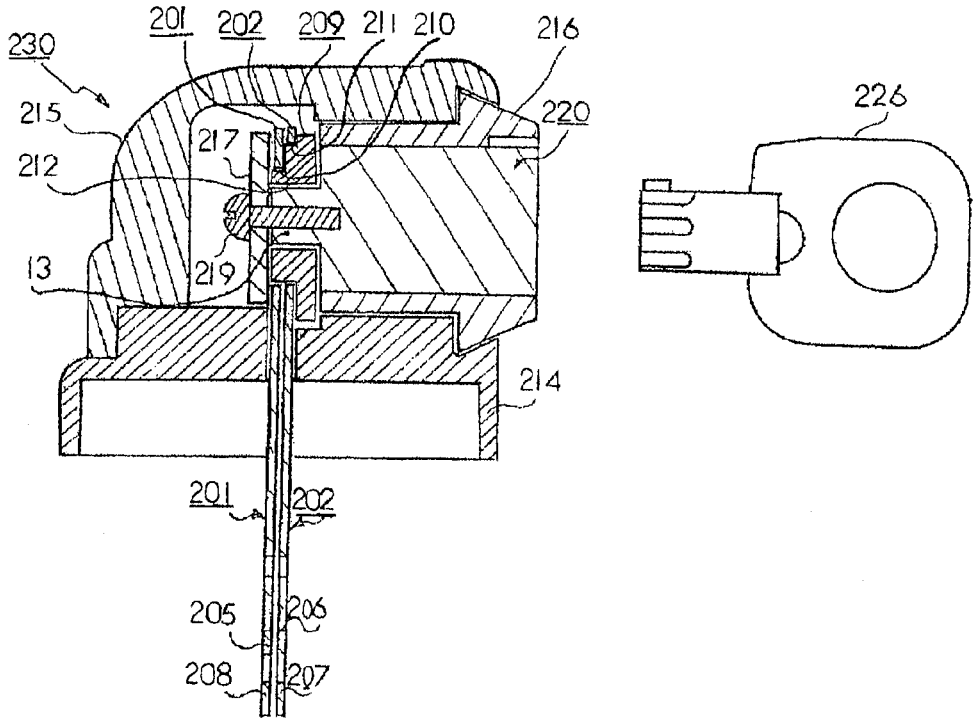
FIG. 13 is a cross-sectional view taken along line X—X of the third embodiment of the lock-picking prevention apparatus.
Figures 14A, 14B:
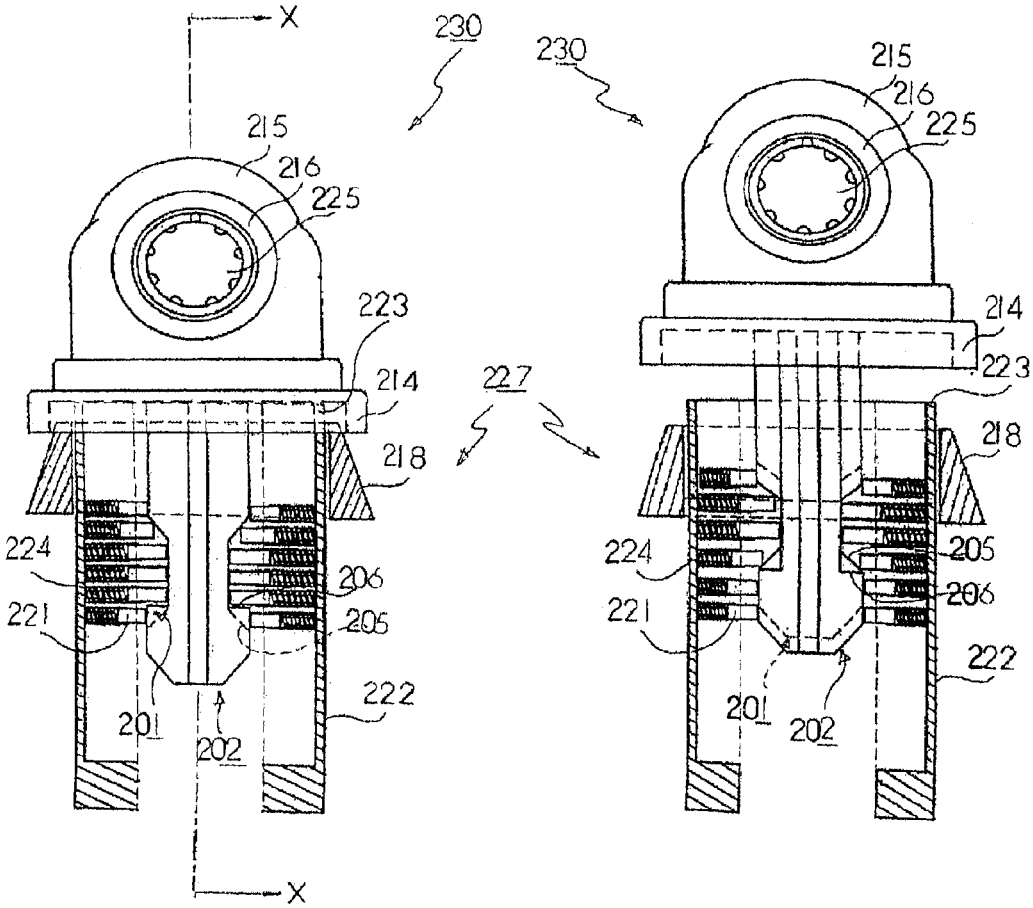
FIG. 14A shows the state where the lock-picking prevention apparatus of the third embodiment is installed.
FIG. 14B shows the state where the apparatus has been unlocked.
Figure 15:
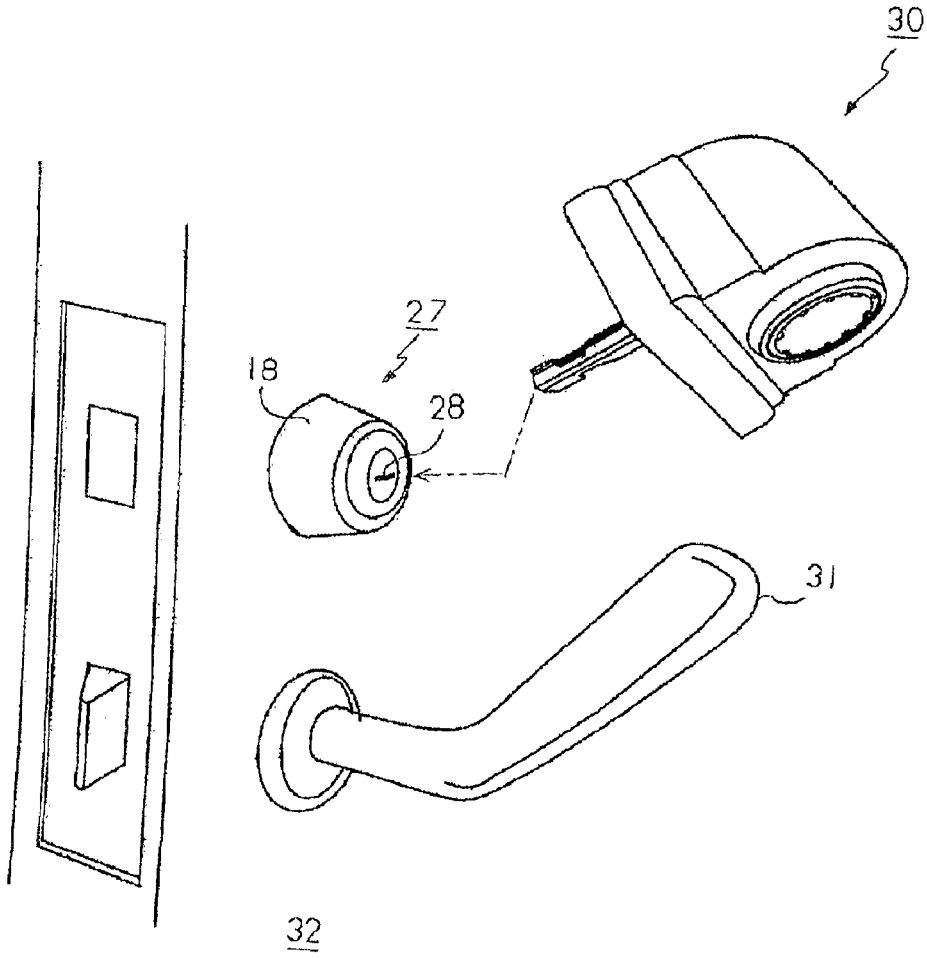
FIG. 15 is a perspective view of the third embodiment of the lock-picking prevention apparatus where the apparatus is installed on a door side lock.

FIGS. 9A and 9B are a front view and a side view of a first locking body 201 of a third embodiment of the lock-picking prevention apparatus. FIGS. 10A and 10B are a front view and a side view of a second locking body of the third embodiment of the lock-picking prevention apparatus. FIGS. 11A to 11C are a side view, a front view, and a perspective view of an eccentric cam disk of the third embodiment of the lock-picking prevention apparatus. FIG. 12 is an exploded view of a rotating part of the third embodiment of the lock-picking prevention apparatus. FIG. 13 is a cross-sectional view of the third embodiment of the lock-picking prevention apparatus. FIG. 14A is a cross-sectional view of the state where the lock-picking prevention apparatus of the third embodiment is mounted on the door side lock, and 14B is a cross-sectional view of the state where the apparatus has been unlocked. FIG. 15 is a perspective view of the third embodiment of the lock-picking prevention apparatus where the apparatus has been mounted on the door side lock.

A "door" as referred to in this specification refers to a door for a house, or cover, etc., and may generally include a lock for a petrol tank for a motorcycle, etc.

FIGS. 9A, 9B and FIGS. 10A, 10B show that a first locking body 201 and a second locking body 202 of a lock-picking prevention apparatus 230 include an oval rotating hole 203 and a circular rotating hole 204, respectively. The first locking body 201 and the second locking body 202 make contact with and freely slide over each other and are inserted integrally into the key hole 228 of the door side lock 227 of a door 232, etc.

The circular rotating hole 204 of the second locking body 202 is a circular hole. The insertion head 207 of the second locking body 202 is provided with a locking hook surface 206 which is at right angles with respect to the inserting direction. In FIG. 14A, when the second locking body 202 is inserted into the key hole 228 of the door side lock 227, the locking hook surface 206 engages with one of the abutment driver pins 221 of the door side lock cylinder 222 of the door side lock 227.

The oval rotating hole 203 of the first locking body 201 increases on either the left or right side or both sides in an arc shape to become a hole in an approximately oval shape where the size in the lateral direction is greater than the size in the vertical direction.

The unlocking sliding surface 205 of the insertion head 208 of the first locking body 201 differs from the locking hook surface 206 in that the unlocking sliding surface 205 is provided with an inclined surface. The unlocking sliding surface 205 slides on the contact surface with a group of the abutment driver pins 221 and causes the engagement of the locking hook surface 206 and the driver pins 221 to be released.

FIG. 11A to FIG. 11C show that the eccentric cam disk 209 has a cam eccentric oval projection outer edge 210 and a cam circular projection outer edge 211. The cam eccentric oval projection outer edge 210 engages with the oval rotating hole 203 provided on the first locking body 201 in a freely rotating manner. The cam circular projection outer edge 211 engages with the circular feting rotating hole 204 provided on the second locking body in a freely rotating manner. The eccentric cam disk 209 rotates when the first locking body 201 and the second locking body 202 make contact with and slide over each other.

The center of the circle of the circular rotating hole 204, which engages with the cam circular projection outer edge 211 in a freely rotating manner, coincides with the center of rotation of the eccentric cam disk 209. Further, the center of an engaging hole 212 coincides with the center of rotation of the eccentric cam disk 209.

The cam eccentric oval projection outer edge 210 is a substantially oval projection and the center of the projection is offset from the center of rotation of the eccentric cam disk 209 by a prescribed distance.

Once the eccentric cam disk 209 rotates, the first locking body 201 slides over the second locking body 202 in the lengthwise direction by an amount corresponding to the prescribed distance, and the unlocking sliding surface 205 of the first insertion head 208 causes the engagement of the locking hook surface 206 and the abutment driver pins 221 to be released.

The combination of the oval rotating hole 203 of the first locking body 201 and the cam eccentric oval projection outer edge 210, and the combination of the circular rotating hole 204 of the second locking body and the cam circular projection outer edge 211 are mounted on the side surface of the eccentric cam disk 209. There is no preferred order of fitting the combinations to the eccentric cam disk providing that the two combinations are pressed against the eccentric cam disk 209.

A disc stopper 229 restricts the angle of rotation of the eccentric cam disk 209 to within a prescribed angle.

FIG. 12 shows the rotating part in a disassembled state. The eccentric cam disk 209 is fixed to the first locking body 201 and the second locking body 202 in a freely rotating manner by the screw 219 and the stopper 217. The convex cylinder part 213 of the lock cylinder 220 causes the eccentric cam disk 209 to rotate.

When the new key 226 is inserted into the new key lock hole 225 of the lock cylinder 220 and rotated, the eccentric cam disk 209 is made to rotate, the cam eccentric oval projection outer edge 210 is rotated so as to slide over the inner surface of the oval rotating hole 203, and the first locking body 201 is made to slide over the second locking body 202 in the lengthwise direction.

Although not shown in the drawings, the new key 226 can also be inserted into the new key lock hole 225 from above in order to change the position of the eccentric cam disk 209, the lock cylinder 220, and the new key 226 by changing the shape of the eccentric cam disk 209.

FIG. 13 shows that the cylinder cap 214 may be hollow. Further, the cylinder cap 214 preferably is of a size capable of covering the whole of the exposed portion 223 and the cylinder bezel 218.

A portion of the cylinder cap 214 may be flat.

In one or more embodiments, if the case 215 of the lock-picking prevention apparatus 230 is not provided with the cylinder cap 214, the lock-picking prevention apparatus 230 may include the first locking body 201 and the second locking body 202 having an engagement piece for engaging with the deepest part of the abutment driver pin 221. Further, a releasing piece to cover the key hole 228 of the door side lock 227 and the case exposed portion 223 may be included in the lock-picking prevention apparatus 230. The lock-picking prevention apparatus 230 may fix the cylinder bezel 218 by pressing the lock-picking prevention apparatus 230 into the door side so that there will be no play between the cylinder bezel 218 and the door when the locking body is inserted into the key hole 228 of the door side lock 227 provided with the cylinder bezel 218.

In one or more embodiments, the structure of the third embodiment of the lock-picking prevention apparatus of the present invention has the following effects.

If the third embodiment of the lock-picking prevention apparatus is used, the locking hook surface 206 of the locking body 202 of the lock-picking prevention apparatus 230 engages with the deepest part of the group of abutment driver pins inside the cylinder 222 of the door side lock 227 and cannot be pulled out. It is therefore possible to block the key hole 228 completely without replacing the current lock with a new lock, which means that illegal unlocking by picking operations, etc., can be prevented.

The lock-picking apparatus 230 can be unlocked only using the dedicated new key 226, so that an effect is the same as providing two locks, which can be achieved simply by mounting this apparatus. The protection provided with respect to picking is therefore vastly improved.

In one or more embodiments, cylinder cap 214 is capable of eliminating cylinder bezel play, which is a serious drawback of door side locks, by being mounted on the lock-picking prevention apparatus 230, which further improves security.

What is claimed is:

1. A lock-picking apparatus of the present invention, which is adaptable to a lock comprising:

a first locking body provided with a first insertion head, inserted in a key hole and having an unlocking sliding surface contacting with an abutment driver pin so as to be capable of sliding with respect to the abutment driver pin;

a second locking body provided with a second insertion head inserted in the key hole and having a locking hook surface for engaging the abutment driver pin, an eccentric cam disk provided in a rotating manner and having a cam eccentric oval projection outer edge fitted in a freely rotating manner to an oval rotating hole provided on the first locking body and a cam circular projection outer edge fitted in a freely rotating manner to a circular rotating hole provided on the second locking body, wherein at the time of unlocking, the first locking body and the second locking body slide over each other as a result of rotation of the eccentric cam disk wherein the first insertion head and the second insertion head are capable of being integrally inserted in the key hole; and at the time of unlocking, the first locking body and the second locking body slide over each other, and the unlocking sliding surface comes into contact with and slides over the abutment driver pin engaging with the locking hook surface, thus enabling the first locking body and the second locking body to be pulled out from the key hole.

2. The lock-picking prevention apparatus as claimed in claim 1, further comprising:

a lock cylinder having a convex cylinder part engaged with an engaging hole provided on an eccentric cam disk; and a new key, wherein the new key is capable of rotating around the lock cylinder, and at the time of unlocking, the eccentric cam disk is made to rotate by rotating the lock cylinder using the new key adaptable to the lock cylinder.

3. The lock-picking prevention apparatus as claimed in claim 1, further comprising: a cylinder cap for fixing a cylinder bezel of the lock to the key hole side.

4. The lock-picking prevention apparatus as claimed in claim 1, further comprising: an outer case for a lock cylinder for blocking the key hole.

* * * * *

UNITED STATES PATENT AND TRADEMARK OFFICE

CERTIFICATE OF CORRECTION

PATENT NO. : 6,854,307 B2
DATED : February 15, 2005
INVENTOR(S) : Gianpiero Toni Mazzarello It is certified that error appears in the above-identified patent and that said Letters Patent is hereby corrected as shown below:

Column 8,
Lines 56-57, replace the phrase "A lock-picking apparatus of the present invention, which is adaptable to a lock comprising:" with -- A lock-picking prevention apparatus adaptable to a lock, comprising: --

Column 9,
Line 8, replace "disk" with -- disk; and --

Signed and Sealed this

Twelfth Day of July, 2005

JON W. DUDAS
*Director of the United States Patent and Trademark Office*